US006916174B2

(12) United States Patent
O'Donnell et al.

(10) Patent No.: US 6,916,174 B2
(45) **Date of Patent: *Jul. 12, 2005**

(54) GAS BURNER

(75) Inventors: Michael J. O'Donnell, Avon, OH (US); Terrance C. Slaby, North Royalton, OH (US); Frank T. Szucs, Jr., Brunswick, OH (US); Jim Bedford, Bay Village, OH (US); Wayne Hollingshead, Guelph (CA)

(73) Assignee: Beckett Gas, Inc., North Ridgeville, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/091,785

(22) Filed: Mar. 6, 2002

(65) Prior Publication Data

US 2002/0132198 A1 Sep. 19, 2002

(51) Int. Cl.[7] ..... F23D 14/10

(52) U.S. Cl. ..... 431/354; 239/432; 239/500; 239/568

(58) Field of Search ..... 431/125, 354; 126/512; 239/419.5, 432, 427, 500, 553, 556, 566, 567, 568

(56) References Cited

U.S. PATENT DOCUMENTS

| | | | | | |
|---|---|---|---|---|---|
| 2,591,235 | A | | 4/1952 | Carter | |
| 3,259,003 | A | | 7/1966 | Griffin | |
| 3,269,165 | A | * | 8/1966 | Anderson | 239/553 |
| 3,540,258 | A | | 11/1970 | Branson | |
| 3,580,512 | A | | 5/1971 | Smith et al. | |
| 3,844,707 | A | | 10/1974 | Wormser | |
| 3,874,839 | A | | 4/1975 | Riehl | |
| 4,195,785 | A | * | 4/1980 | Blanzy | 239/566 |
| 4,346,845 | A | | 8/1982 | Meyerhoff et al. | |
| 4,418,456 | A | | 12/1983 | Riehl | |
| 4,726,351 | A | | 2/1988 | Whitaker et al. | |
| 4,930,490 | A | | 6/1990 | Allan | |
| 4,951,880 | A | | 8/1990 | Riehl | |
| 4,971,031 | A | | 11/1990 | Richardson | |
| 4,976,253 | A | | 12/1990 | Beal et al. | |
| 5,052,370 | A | | 10/1991 | Karabin | |
| 5,069,200 | A | | 12/1991 | Thow et al. | |
| 5,081,981 | A | | 1/1992 | Beal | |
| 5,114,336 | A | | 5/1992 | Karabin et al. | |
| 5,320,520 | A | | 6/1994 | Barth et al. | |
| 5,328,356 | A | | 7/1994 | Hawkinson | |
| 5,336,082 | A | | 8/1994 | Riehl | |
| 5,392,763 | A | | 2/1995 | Shaw et al. | |
| 5,399,084 | A | | 3/1995 | McCullough et al. | |
| 5,584,680 | A | | 12/1996 | Kim | |
| 5,601,073 | A | | 2/1997 | Shimek | |
| 5,647,341 | A | | 7/1997 | Langman et al. | |
| 6,027,336 | A | * | 2/2000 | Nolte et al. | 431/354 |
| 6,371,753 | B1 | * | 4/2002 | O'Donnell et al. | 431/125 |

* cited by examiner

*Primary Examiner*—Sara Clarke
(74) *Attorney, Agent, or Firm*—Watts Hoffmann Co., LPA

(57) ABSTRACT

A burner having an elongate, generally tubular sheet metal body having an inlet end, a closed distal end and a tubular segment extending between the ends. The inlet end is formed to define a gas orifice holder which is adapted to mount a gas orifice element. The inlet end is further formed to define at least one primary air opening arranged to admit primary air from a source of primary air. Rows of flame ports are defined in the tubular segment and are arranged to create a desired predetermined flame pattern. When used as a fireplace burner the flame ports may be slot-like in construction and include tabs which determine the effective size of the ports. In a fireplace application, flame ports located below a crossover log, are eliminated and/or formed of reduced size, thus providing a flame of lower height and/or less intensity, thus substantially eliminating sooting. When used as a premix-type burner, a source of primary air under pressure is delivered to the inlet end of the burner and compensates for the restriction posed by the bluff structure, resulting in a blue flame.

10 Claims, 5 Drawing Sheets

GAS BURNER

TECHNICAL FIELD

The present invention relates generally to gas burners and, in particular, to a cost effective premix type gas burner.

BACKGROUND ART

Premix-type burners are used in boilers and other heating applications where combustion air is fed, under pressure, to a plenum chamber. The combustion air enters one or more burners which have inlets that communicate with the plenum chamber and is mixed with fuel, such as natural gas. The mixture is then burned within a combustion chamber forming part of the appliance. The efficiency of this type of appliance is in part determined by the primary air/fuel mixing capability of the burner.

It is desirable to provide a cost effective burner for this type of application which also provides effective primary air/fuel mixing capability.

DISCLOSURE OF INVENTION

In one embodiment, the invention provides a new and improved gas fireplace burner intended for use with non-combustible log members which produces a yellow flame and no sooting or substantially reduced sooting. In another embodiment, the invention provides a new and improved premix-type burner which provides efficient mixing of primary air and fuel and is also cost effective.

According to one preferred embodiment, the gas fireplace burner, which is intended to burn gaseous fuels, such as natural gas, butane, propane, etc. includes an elongate, generally tubular body having an inlet end and a closed distal end. A tubular segment extends between the ends. In one preferred and illustrated embodiment, the burner body is made from sheet metal, preferably tubular sheet metal, which can be readily formed and shaped. The inlet end of the body is formed to define a gas orifice holder which mounts a gas orifice element. The inlet end is further formed to define at least one combustion air opening which operates to admit combustion air into an interior region of the body.

A bluff body is located downstream from the gas orifice element and is positioned such that gas emitted by the orifice impinges on the bluff body. The bluff body forces the gas to move to either side of the body and, in so doing, is encouraged to mix with the incoming combustion air.

A series of flame ports are defined by the tubular segment in order to create a desired, predetermined flame pattern. The flame pattern may be dictated in part by the arrangement of the non-combustible log members.

According to a more preferred embodiment, the inlet end of the burner body is formed with a second combustion air opening. The first and second openings are preferably arranged such that the orifice holder is located intermediate the openings.

According to a feature of the invention, the cross-section of the combustion air openings are sized during the forming operation to accommodate the type of gas to be used and/or the gas flow rate sustainable by the gas orifice.

With the disclosed invention, a relatively inexpensive burner for use in artificial fireplaces is provided. The burner can accommodate a wide variety of orifice sizes and gas types. The inlet end, as indicated above, defines the combustion air openings, the size of which are determined during the forming operation. As a consequence, a single burner design can be used with a wide variety of gases and orifice sizes merely by changing the cross-section of the formed inlet end.

The flame ports are formed in the tubular segment of the burner body and, in the preferred embodiment, are arranged in a linear pattern. Although the flame ports may be simple punched holes of various sizes, in the preferred embodiment, at least some of the flame ports are slot-like in configuration and have an effective size that is determined by the orientation of a bent tab element that partially defines each of the ports. These ports are preferably formed by a "lancing" operation which utilizes a punch element that pierces the surface of the tubular segment to form the tab that bends downwardly into the burner plenum. The tab is bent downwardly to define an opening in the burner body through which the gas/air mixture is emitted. In the preferred method, the extent to which the punch is driven into the burner body determines the extent to which the port tabs are bent and, hence, the effective size of the port opening. According to the invention, certain areas of the burner may be formed with smaller sized ports in order to produce a smaller flame at that location. For example, flame ports that are located below a "crossing log", i.e., a log that is positioned across and supported atop front and rear non-combustible logs forming part of the fireplace assembly, may be of smaller size.

In the illustrated embodiment, the flame ports are arranged in two or more spaced apart rows of adjacent slot-like openings. In the exemplary embodiment, one row of flame ports extends along a substantial length of the tubular segment. Two other row segments of flame ports are preferably arranged in a parallel relationship with the first row of ports, but are longitudinally spaced with respect to each other. In the preferred embodiment, the first row of ports is segmented and includes a central portion that is formed with smaller flame ports. This disclosed arrangement which includes a first row with a central portion having reduced flame port size coupled with two additional, spaced apart row segments of ports leaves a central region of the burner where the flame is smaller or less intense. This reduced flame in the central region allows a transverse log member to be placed across the front and rear log members used in the fireplace assembly. By providing a lower flame height below the transverse log member, sooting is eliminated, or at the very least, substantially reduced. It should be noted here that the present invention contemplates the provision of reduced size ports at other positions in the tubular body to accommodate the positioning of transverse log members. For example, if two transverse log members are used, rows of ports could be provided with reduced port sizes at opposite ends and/or the elimination of flame ports at end segments of flame port rows. In short, the present invention contemplates using either reduced flame port sizes and/or the elimination of flame ports in certain regions of the burner to provide lower flame height below log members.

The burner is especially adapted to be used in an artificial fireplace which utilizes front and rear spaced apart non-combustible log members supported on a log support, such as a grate. The lower flame present in the central portion of the burner allows a transverse log member to be placed across the front and rear log members. By providing a reduced or smaller flame in the central region of the burner body, sooting on the transverse log member is eliminated or substantially reduced.

According to an alternate embodiment of the invention, the bluff body is formed by a pair of confronting depressions formed near the inlet end of the burner body. The confronting dimples or depressions form a pair of venturi channels that communicate with the combustion air openings and control or effect air entrainment. The dimple defines structure that is in a confronting relationship with the orifice element, so that gas emitted by the element must move to either side of the dimple and through the venturi channels. In so doing, the fuel gas is mixed with the incoming combustion air in proper proportion.

It has been found that the disclosed burner provides a very effective yellow flame producing burner that is especially adapted to be used in artificial fireplaces. Unlike prior art burners of this type, relatively large combustion air openings are provided so that clogging of the air inlet by lint, etc. is inhibited. It has been found that with the disclosed construction, the port nearest the orifice can be at a distance that is less than 2½ times the diameter of the tube, which results in a short mixing chamber, i.e., a relatively short segment of the burner body devoted to receiving and mixing the combustion air with the gas.

An embodiment is also disclosed where the invention is used to provide a premix-type burner for a boiler or other appliance in which the primary air is fed under pressure to a burner. In the illustrated embodiment, the burner comprises an elongate tube having an orifice holder defined at one end for holding an orifice. In addition, a bluff structure is formed immediately downstream of the orifice holder and, in the illustrated embodiment, is defined by a pair of dimples which form mixing passages through which combustion or primary air and fuel emitted by the orifice travel and are mixed prior to being discharged through a plurality of ports defined by the tube. The primary air/fuel mixture emitted by the ports is burned in a combustion chamber.

The products of combustion are conveyed or travel through a heat exchanger structure where the heat of combustion is transferred to a heating medium which may be water or other fluid for a boiler application or air in a forced air heating application. In the construction of the disclosed premix-type burner, primary air openings are also defined downstream of the orifice holder and provide the means by which primary air, under pressure, is conveyed into the end of the burner and mixed with incoming fuel.

Additional features of the invention will become apparent and a fuller understanding obtained by reading the following detailed description made in connection with the accompanying drawings.

BEST MODE FOR CARRYING OUT THE INVENTION

Figure 1:
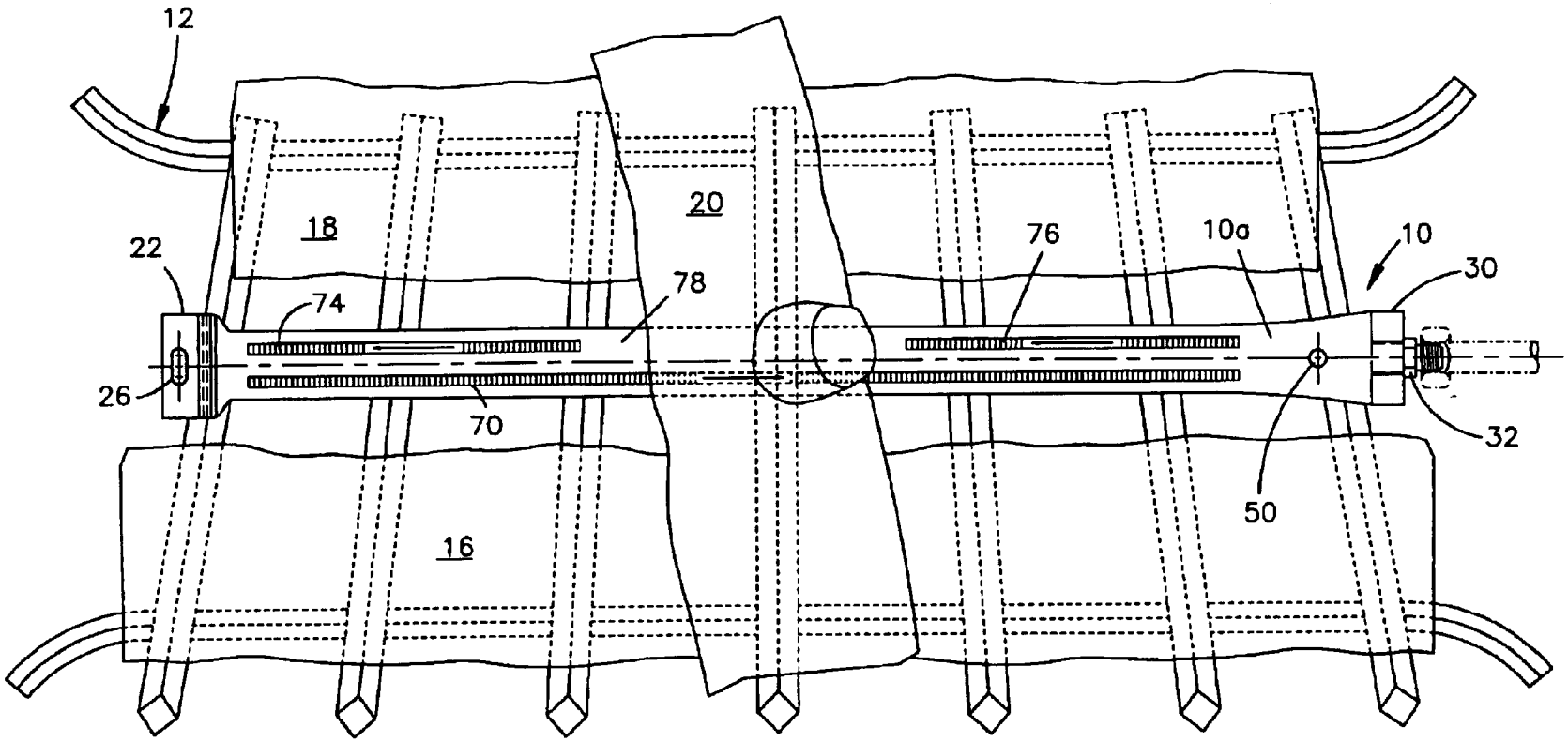
FIG. 1 is a top plan view of a artificial fireplace utilizing the burner of the present invention.

FIG. 1 illustrates one preferred embodiment of a gas burner 10 that is especially adapted to be used in a gas fired, artificial fireplace. In its preferred embodiment, the burner produces a yellow flame that simulates the type of flame seen in a log burning fireplace. As seen in FIG. 1, the gas burner 10 may form part of a fireplace assembly which includes a grate 12 upon which artificial logs are located. In the illustrated embodiment, the gas burner 10 is located between relatively large front and back simulated non-combustible logs 16, 18. A smaller simulated log 20 is supported by the large logs 16, 18 and extends transversely with respect thereto.

Figure 2:
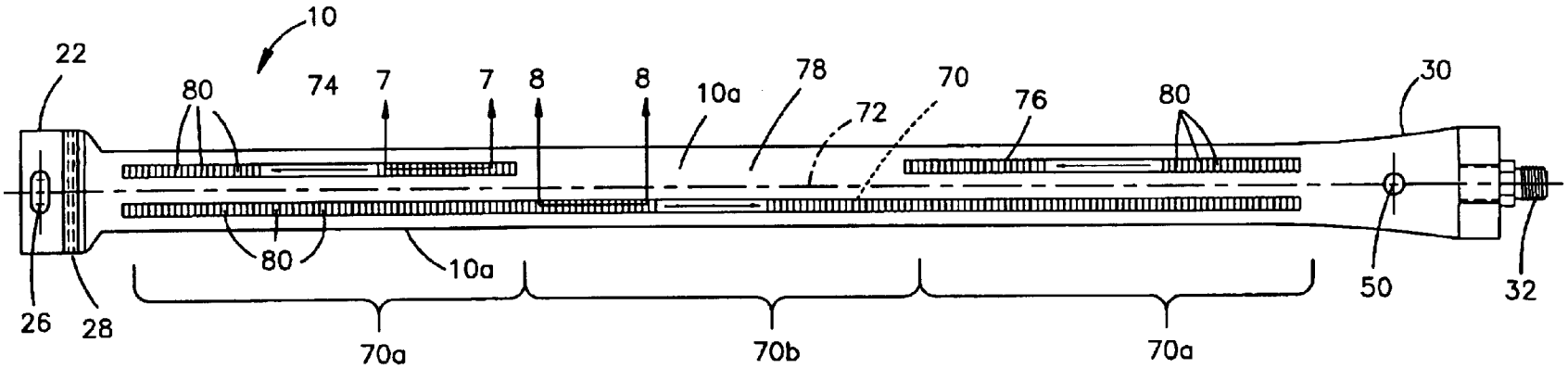
FIG. 2 a top plan view of a burner constructed in accordance with the preferred embodiment of the invention.
Figure 3:
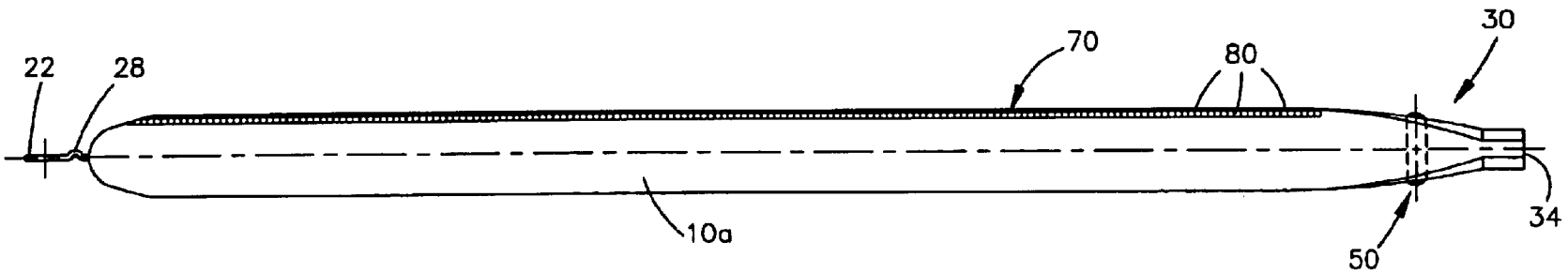
FIG. 3 is a side view of the burner shown in FIG. 2.

Referring also to FIGS. 2 and 3, the gas burner 10 is preferably formed from an elongate tube 10*a*. A distal end 22 is sealed in a crimping operation and defines a closure for a gas tight seal and a mounting flange including a hole or a slot 26. A rigidizing rib 28 is also preferably formed in the mounting flange.

According to the invention, an inlet end 30 of the tube 10*a* defines a mounting for a gas orifice 32, as well as primary air openings 34 (shown in FIG. 4) through which combustion air is admitted into the burner 10. In accordance with the invention, the primary combustion air openings 34 are sized, during manufacture, to accommodate the type of gas that will be used in the fireplace.

Figure 4:
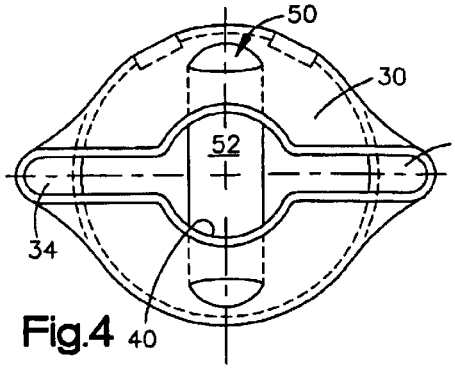
FIGS. 4–6 are end views of the gas burner showing alternate configurations for the inlet end of the burner to accommodate various gaseous fuels.
Figure 5:
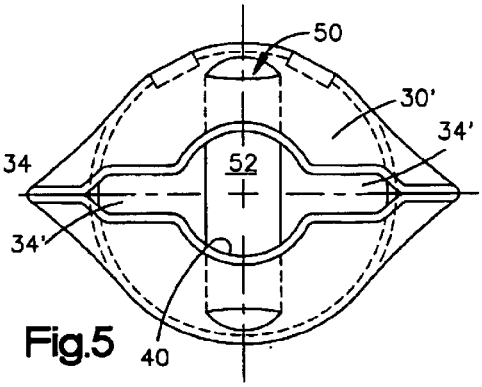
Figure 6:
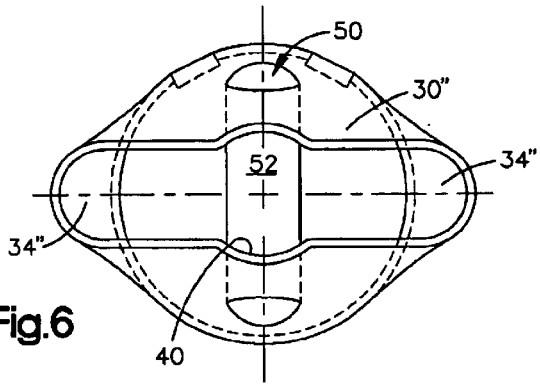

In the preferred and illustrated embodiment, a circular, gas orifice support 40 is integrally formed in the inlet end 30 of the tube 10*a* (shown best in FIGS. 4–6). The sizing of the circular portion 40 is adjusted to provide a significant gripping force on the orifice 32 when the orifice element 32 is inserted into the orifice support portion 40. In the preferred embodiment, the combustion air openings 34 extend laterally from either side of the support portion 40. The size of the openings 34 is adjusted during the crimping operation, since combustion air requirements vary depending on the type of gas to be used and the gas input rating. Preferably, the air openings are of a generally rectangular or ovular shape and have an aspect ratio (length/width) greater than 1.5 and a minimum dimension of 0.125".

FIGS. 5–6 illustrate alternately sized combustion air openings 34' and 34" which enable the burner to be used with alternate gas sources such as natural gas, propane gas, etc. or enable the burner to operate at an alternate gas input. The final size of the primary air openings 34 is determined by the type of gas to be used, the gas pressure and/or the gas flow rate sustained by the gas orifice 32. In accordance with the invention, conventional crimping or other metal forming operations are used to define the final cross-section of the combustion air end openings 34, 34'34".

In accordance with a feature of the invention, a bluff body 50 is located immediately downstream from the orifice 32. Referring to FIGS. 3 and 4, the bluff body 50 may comprise a pin 52 extending vertically along a diametral line of the gas burner body 10*a*. As seen in FIGS. 4–6, the pin is centered with respect to the orifice holder portion 40, such that gas emitted by the orifice element 32 impinges on a central portion of the pin 52. The location of the pin 52 promotes mixing of the gas with the incoming combustion air. The region surrounding the pin 52 forms a mixing chamber As seen best in FIG. 2, linear patterns of adjacent flame ports are formed along the length of the burner 10*a*. In the illustrated embodiment, three rows of ports are formed in the tube 10*a* and are arranged as follows. A first row of ports 70 extends substantially the full length of the burner body 10*a* and is located to one side of a longitudinal center line 72. Positioned across the centerline in a parallel relationship with the row 70 are two longitudinally smaller row segments of flame ports 74, 76. The flame port row segments 74, 76 as seen in FIG. 2, are spaced apart but aligned with each other. As seen in FIG. 2, the arrangement of ports defines a region 78 on the burner body where flame ports are not formed. This region 78, as seen in FIG. 1, is aligned with the transverse log member 20.

The size of the port openings can vary and are determined during the manufacturing operation. The height of the flames emitted by each individual port is determined, at least in part, by the effective port opening.

Figure 7:
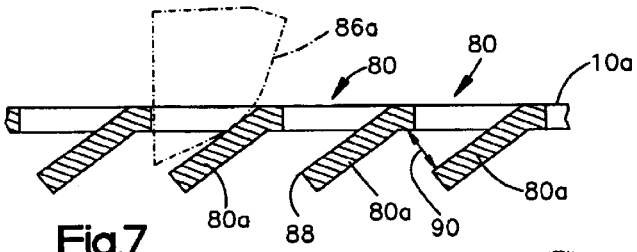
FIG. 7 is fragmentary sectional view of the burner as seen from plane indicated by the line 7—7 in FIG. 2.

Referring in particular to FIG. 7, the configuration of the individual ports is illustrated. The flame port rows 70, 72, 74 comprise a series of adjacent slot-like ports 80. In the preferred and illustrated embodiment, the ports are formed using a punching or "lancing" operation.

Figure 8:
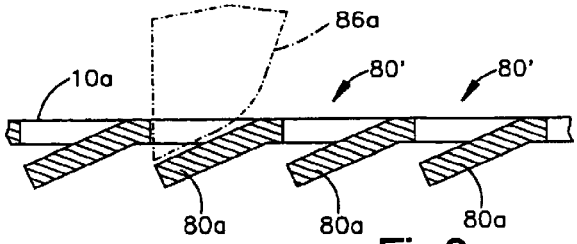
FIG. 8 is a fragmentary sectional view of the burner as seen from the line 8—8 in FIG. 2.

Referring to FIGS. 2, 7 and 8, the ports are formed as slots in the tube body 10*a*. Tabs 80*a* are formed during the punching operation and are bent downwardly by a tool 86 having a suitably formed tip 86*a* that shears the burner tube material along three edges, i.e., two side edges and a front edge. As seen best in FIGS. 7 and 8, the effective size of a port 80 is determined by the angle of adjacent tabs 80*a*. In effect, the adjacent tabs form a throat or channel through which the gas must travel. The effective port size of a port 80 is the distance between a lower edge 88 of a tab 80*a* and an adjacent tab as measured along a line orthogonal to an upper surface of the tab. This line is indicated in FIG. 7 by the reference character 90.

FIG. 8 illustrates ports 80' having a effective size that is smaller than the ports 80 shown in FIG. 7. In other words, for a given gas pressure the ports 80 shown in FIG. 7 will produce a larger flame height than the ports 80' shown in FIG. 8. The ports 80' effectively reduces flame height, and when used in connection with the ports 80 allow a full size flame for overall aesthetics while providing reduced flame height under crossing logs. In particular, the reduced flame height provided by the ports 80' prevents the flame from directly impinging on a crossing log which would otherwise cause sooting as well as provides carryover of flame at ignition between the full size flame regions.

In the illustrated embodiment, the combination of the smaller ports 80' and the portless region 78 result in a smaller overall flame segment below the log 20 and, hence, the potential for sooting is eliminated or substantially reduced. In short, the central portion of the burner has a smaller overall flame height or flame of less intensity as compared to the outer ends of the burner tube.

According to the preferred embodiment, the angle of the tabs in a given row of ports may vary. Referring in particular to FIG. 2, segments 70*a* of the flame port row 70 include the port configuration shown in FIG. 7. A central segment 70*b* of the flame port row 70 is configured with the smaller ports 80' shown in FIG. 8. This disclosed configuration produces a smaller flame in the center of the burner. This is desirable since this region of the burner is below the transverse log 20. The ports 80 in the flame port rows 72, 74 are configured as in FIG. 7 and, as a result, produce a larger flame height. Other patterns of flames and flame heights can be produced by changing the angle to which the size defining tabs 80*a* are bent. In general, port arrangements (i.e. location and size) are selected to provide proper burning characteristics and aesthetics consistent with log set design.

Figure 9:
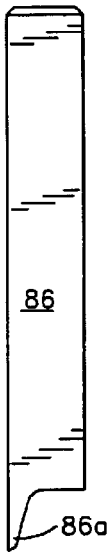
FIGS. 9 and 10 illustrate the construction of a punching tool that can be used to form the flame ports in the burner.
Figure 10:
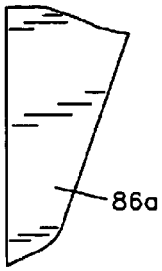

As seen in FIGS. 9 and 10, the punching tool 86 having the piercing tip 86*a* can be used to "lance" the ports into the burner body 10*a*. The angle to which the resulting tabs 80*a* are bent is determined by the depth to which the punch tip 86*a* is driven.

Figure 11:
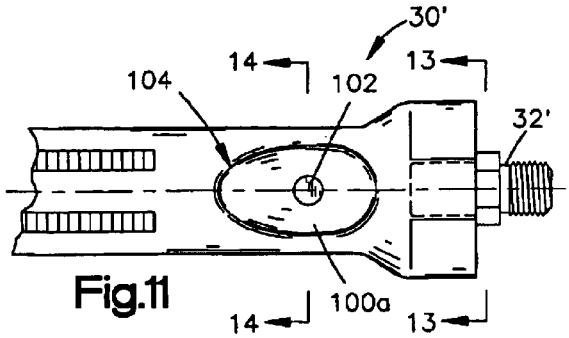
FIG. 11 illustrates a fragmentary elevational view of an alternate embodiment of the burner.
Figure 12:
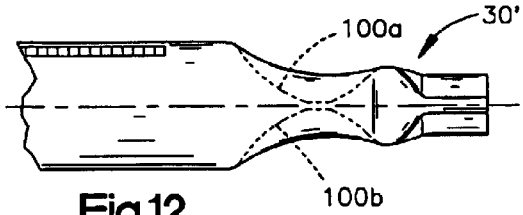
FIG. 12 is a side view of the alternate embodiment of the burner shown in FIG. 11.
Figure 13:
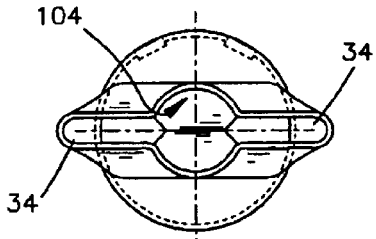
FIG. 13 is a view of the burner as seen from the plane indicated by the line 13—13 in FIG. 11.
Figure 14:
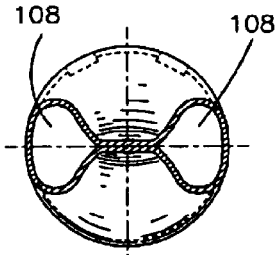
FIG. 14 is a cross-sectional view of the burner as seen from a plane indicated by the line 14—14 in FIG. 11.

FIGS. 11–14 illustrate an alternate embodiment of the invention. In this embodiment, the bluff pin 52 (shown in FIGS. 3–6) is replaced by a "dimple" that is formed in an inlet end 30' of a tube body 10*a*. As seen best in FIG. 12, the inlet end 30' of the gas tube is formed with two confronting, substantially symmetrical depressions 100*a*, 100*b* which contact each other at a region indicated by the reference character 102 (FIG. 11). A "bluff" structure indicated generally by the reference character 104 (FIG. 13) is thus formed directly downstream from a gas orifice 32'. As seen in FIG. 14, a pair of spaced apart, symmetrical passages 108 are formed to either side of the bluff structure 104. The disclosed construction forces the gas emitted by the orifice 32' to be split and diverted so that it flows through the spaced apart passages 108 where it is mixed with the incoming primary air. In effect the passages 104 form a mixing chamber. It has been found that this configuration which utilizes a formed bluff structure 104 with passages 108 to either side, provides an flame extinguishing function should "light back" occur in the burner. Those in the art will recognize that light back occurs when flame is drawn into the burner air inlet and ignites the gas/air mixture inside the burner tube. It has been found that a flame initiated by light back will not be sustained due to this inlet end configuration.

It has been found that the disclosed construction provides a very efficient and cost effective burner that is especially adapted to be used in artificial fireplaces. It has been found that the disclosed inlet arrangement allows a shorter distance between the first port and the gas inlet. Generally, in the past it was desirable to have the distance from the orifice to the first port to be at least 6 times the diameter of the burner body. With the disclosed configuration, it has been found that the first port may be at a distance 2½ times the diameter or less as measured from the gas discharge point on the gas orifice 32. This relatively short mixing chamber decreases the overall size of the burner while still providing sufficient mixing of the gas with the primary air, so that flame stability is maintained.

With the disclosed invention it has been found that the distance between the bluff body and the first flame port (the flame port closest to the gas orifice) may be 2 times the burner body diameter or less. The distance between the bluff body and the gas orifice may also be 2 times the tube diameter or less.

Figure 15:
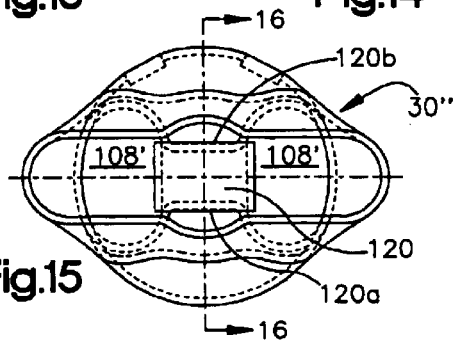
FIG. 15 is an end view of an alternate embodiment of the burner.
Figure 16:
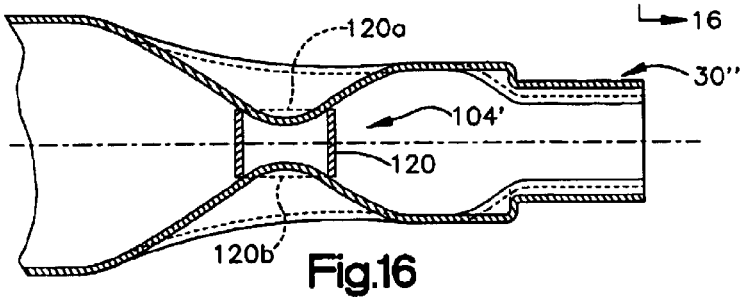
FIG. 16 is a sectional view of the alternate burner as seen from the plane indicated by the line 16—16 in FIG. 15.

FIGS. 15 and 16 illustrate another embodiment of the invention. This third embodiment combines features of the first embodiment (FIGS. 1–11) and the second embodiment (FIGS. 12–14). In particular, the third embodiment includes a partial dimple construction, which is shown best in FIG. 16. A bluff structure indicated generally by the reference character 104' is formed downstream from a gas orifice (not shown). An inlet end 30" of a tube body 10*a*" is formed with two confronting, substantially symmetrical depressions 100*a*', 100*b*' which, unlike the embodiment of FIGS. 12–14 do not contact each other but instead contact and maintain the position of a cylindrical bluff element 120. The bluff 120 element may comprise a short cylindrical, tubular segment having opposite, open ends 120*a*, 120*b*. As seen best in FIG. 16, portions of the recesses 100*a*' and 100*b*' deform into the open ends 120*a*, 120*b* and thus, securely mount the bluff element 120. As seen best in FIG. 15, a pair of venturi channels 108' are thus formed on either side of the bluff element 120.

The combination of the tube or pin and dimples provides the advantage of a shortened mixing chamber as well as substantially eliminating light back.

FIGS. 17–20 illustrate a boiler application for the disclosed invention. In the illustrated construction, the burner resembles the construction of the embodiment shown in FIGS. 11–14. However, it should be understood that burner configurations similar to those shown in FIGS. 1–6 and 15–16 may also be used in the boiler application to be described.

In the disclosed boiler application, as will be explained, the burner produces a conventional "blue" flame, rather than the "yellow" flame described in connection with the embodiments disclosed in FIGS. 1–8 and 11–16. In the application disclosed in FIGS. 17–20, the efficient mixing feature provided by the invention is utilized to provide a cost effective burner for a boiler or other heating appliance.

Figure 17:
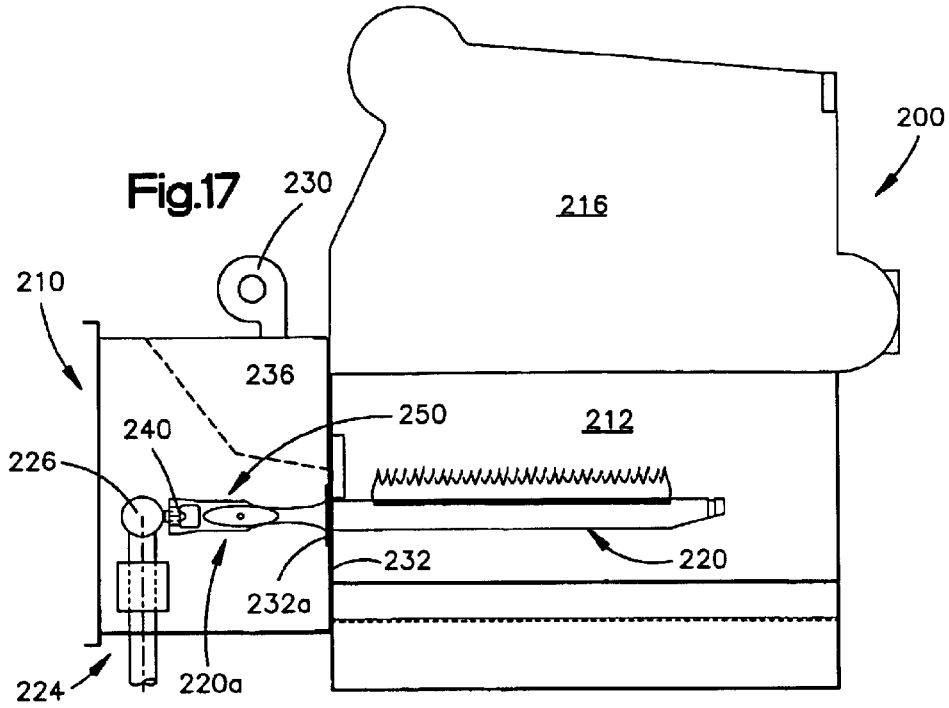
FIG. 17 schematically illustrates a boiler which includes a burner constructed in accordance with another embodiment of the invention.

Referring first to FIG. 17, a gas fired boiler 200 is schematically illustrated. The boiler 200 includes a combustion air inlet plenum indicated generally by the reference character 210, a combustion chamber 212 and a heat exchanger chamber 216. The heat exchanger chamber 216 is of conventional construction and includes heat transfer structure which transfers heat from the products of combustion that exit the combustion chamber 212 to water or other fluid (not shown) that is conveyed through the heat exchanger structure. It should be noted that the disclosed embodiment is applicable to other types of heating appliances and should not be limited to the boiler type furnace illustrated in FIG. 17.

In the schematic shown in FIG. 17, a single burner 220 is illustrated. It should be understood, however, that in an actual boiler multiple burners 220 of the same or substantially similar construction, would be used in order to provide the required BTU output for the boiler. To facilitate the explanation, only a single burner will be referred to.

Figure 18:
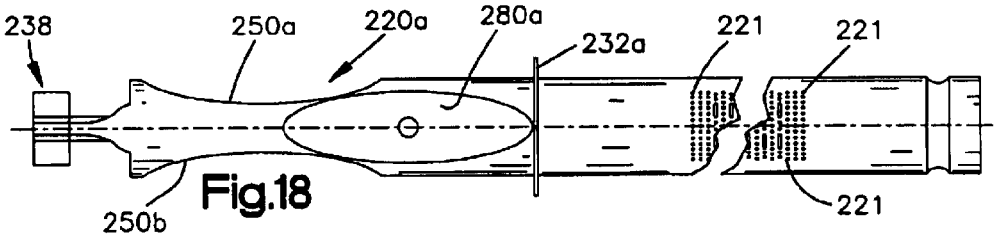
FIG. 18 illustrates the construction of the burner shown in FIG. 17.
Figure 19:
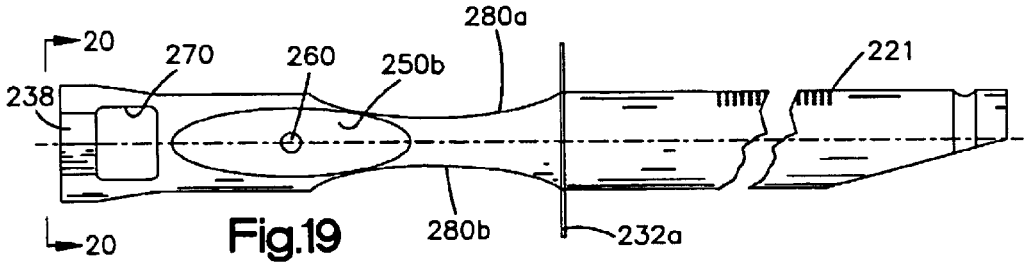
FIG. 19 is another illustration of the burner rotated 90° from the position shown in FIG. 18; and, FIG. 20 is an end view of the burner shown in FIG. 19, as seen from plane indicated by the line 20—20.
Figure 20:
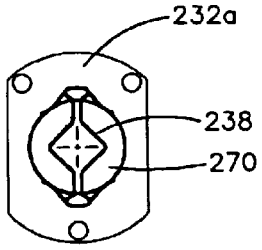

Referring also to FIGS. 18–20, the burner 220 is connected to a conventional gas supply line 224. The gas supply line 224 may be connected to a manifold 226 which may extend transversely in the plenum chamber 210. As is conventional, the manifold 226 would be connected to each of the burners forming part of the boiler and would concurrently feed fuel (i.e. natural gas from the gas supply line 224) to all of the burners.

A forced air blower 230 is mounted to the combustion air inlet plenum 210 and provides a source of primary air, under pressure, for the burner 220. As described in connection with the embodiments shown in FIGS. 1–8 and 11–16, the configuration and bluff structure formed on the inlet side of a burner poses a restriction to the incoming primary air. As a result, in a normally aspirated configuration of the burner, less than a stoichiometric amount of air can be admitted into the burner, and, resulting in a yellow flame. For a fireplace application this is desirable; for a boiler application a yellow flame is undesirable.

According to this embodiment, the invention is used with a pressurized or forced air combustion system where the pressurized combustion air compensates for the restriction posed by the bluff structure. The blower 230 forces a stoichiometric amount of primary air into the burner 220 which results in an efficient, blue flame. The invention, however, still effects efficient mixing of the primary air and fuel.

In the preferred construction of this embodiment, an inlet end 220*a* of the burner 220 is positioned within the combustion air inlet plenum 210. The remainder of the burner which include burner ports 221 (see FIGS. 18 and 19) is positioned within the combustion chamber 212. The burner ports 221 may be simple punched holes of various sizes or the slot-like ports described in connection with FIGS. 7 and 8.

The combustion air inlet plenum 210 is separated from the combustion chamber 212 by an internal plenum wall 232. The burner 220 extends through the wall 232 and is preferably mounted and sealed to the plenum wall via a flange 232*a* (shown in FIGS. 18 and 19) so that the chamber defined by the inlet plenum is isolated from the combustion chamber 212. Fasteners (not shown) secure the flange 232*a* to the plenum wall 232. Consequently, the primary air forced into the plenum 210 by the blower 230 must all pass through the inlet end(s) 220*a* of the burner(s), rather than being able to enter the combustion chamber 212 as is the case with a conventional, natural draft type boiler. In the embodiment illustrated in FIG. 17, the combustion air inlet plenum includes a baffle 236 which acts to distribute the primary air discharged by the blower 230, throughout the inlet chamber so that when multiple burners are used, each receives substantially the same quantity of primary air.

As seen best in FIGS. 19–20, the burner 220 includes an orifice holder 238 formed by crimping the end of the tube in a predetermined configuration substantially similar to the orifice holder forming part of the embodiment in FIGS. 1–8 and 11–16. The orifice holder 238, as seen in FIG. 17, mounts a gas orifice 240. Also formed in the inlet end 220*a* of the burner 220 is a bluff structure 250 which, in the preferred construction of this embodiment, is defined by at least one dimple. In the more preferred embodiment, two confronting, substantially symmetrical depressions 250*a*, 250*b* are formed on the inlet end 220*a* of the burner 220, downstream from the gas orifice 240.

In the preferred and illustrated construction of this embodiment, the two confronting depressions contact each other at a region indicated by the reference character 260 (FIG. 19). As is the case with the embodiments shown in FIGS. 11–14, a pair of spaced apart, symmetrical passages are formed by the confronting dimples (the same or similar to the passages 108 shown in FIG. 14). Like the bluff structure 104 in FIGS. 11–14, the bluff structure 250 forming part of the burner 220 forces the gas emitted by the orifice 240 to be split and diverted so that it flows through the spaced apart passages where it is mixed with the incoming primary air. The passages form a mixing chamber which results in a "premix-style" burner that is cost effective and provides excellent mixing of the primary air with the fuel emitted by the orifice 240.

In the embodiment shown in FIGS. 17–20, the primary air which is forced into the plenum chamber 210 by the blower 230, is preferably admitted into the inlet end 220*a* of the burner through primary air openings 270, rather than through just end openings defined by the orifice holder as is the case with the embodiment shown in FIGS. 11–14.

In the preferred construction of this embodiment, an additional pair of confronting dimples 280*a*, 280*b* are formed downstream of the bluff structure and are preferably rotated 90° with respect to the dimples 250*a*, 250*b* forming the bluff structure 250. The additional dimple structure which defines a pair of channels the same or similar to the channels or passages 108 described above provides additional mixing of the gas and air.

The application of the invention disclosed in FIGS. 17–20 provides a premix-style burner for use in a boiler or other application where primary air is forced into the burner by an auxiliary blower. The invention provides a very simple and cost effective burner for this type of application that has superior gas/primary air mixing.

Although the invention has been described with a certain degree of particularity, it should be understood that those skilled in the art can make various changes to it without departing from the spirit or scope of the invention as hereinafter claimed.

We claim:

1. A gas burner comprising:

a) a source of primary air under pressure;

b) an elongate, generally cylindrical sheet metal body, having an inlet end, a closed distal end and a tubular segment extending between said ends;

c) said distal end defining a mounting flange;

d) said inlet end being formed to define a gas orifice holder, said holder mounting a gas orifice element;

e) said inlet end further formed to define at least one primary air opening arranged to admit primary air from said source into said tubular segment;

e) a bluff body located downstream from said gas orifice element and positioned such that gas emitted by said orifice flows along a flow path and impinges on said bluff body, said bluff body formed at least partially by a one dimple formed near said inlet end that projects into said flow path, a center point of said dimple being located downstream of said orifice element; and, f) a series of flame ports defined in said tubular segment and arranged to create a desired, predetermined flame pattern.

2. The gas burner of claim 1, wherein said flame ports are arranged in a linear pattern and at least some of said flame ports being slot-like in configuration and having an effective size determined by the orientation of a bent tab element that partially defines each of said ports.

3. The gas burner of claim 2, wherein said linear pattern of flame ports comprises three rows of adjacent slot-like openings.

4. The gas burner of claim 1, wherein said bluff structure includes a second dimple positioned in a confronting relation to said one dimple.

5. A gas burner comprising:

a) a source of primary air under pressure;

b) an elongate, generally cylindrical sheet metal body, having an inlet end, a closed distal end and a tubular segment extending between said ends;

c) said distal end defining a mounting flange;

d) a gas orifice element mounted at said inlet end;

e) said inlet end further formed to define at least one primary air opening arranged to admit primary air from said source into said tubular segment;

e) a bluff body located downstream from said gas orifice element and positioned such that gas emitted by said orifice flows along a flow path and impinges on said bluff body, said bluff body formed at least partially by a one dimple formed near said inlet end that projects into said flow path, a center point of said dimple being located downstream of said orifice element; and, f) a series of flame ports defined in said tubular segment and arranged to create a desired, predetermined flame pattern.

6. The gas burner of claim 5, wherein said inlet end is formed to define a gas orifice holder, said holder mounting said orifice.

7. The gas burner of claim 5, wherein said inlet end further defines primary air openings through which air under pressure is admitted to said burner.

8. The gas burner of claim 5, further including additional mixing structure comprising at least one dimple located downstream of said bluff structure for providing additional mixing of said fuel and air.

9. A gas burner comprising:

a) an elongate, generally cylindrical sheet metal body having an inlet end and a closed distal end and a tubular segment extending between said ends;

b) said inlet end including an integrally formed gas orifice holder, said holder mounting a gas orifice element;

c) said inlet end further formed to define at least one primary air opening arranged to admit primary air into said tubular segment:

d) a plurality of flame ports defined in said tubular segment downstream from said inlet end, at least some of said flame ports being formed by partially punching through a wall of said tubular segment leaving an inwardly bent tab, the effective opening of said some flame ports being determined by an extent to which said tab is bent;

e) a mixing chamber disposed between said orifice holder and said flame ports whereby gas emitted by said orifice is mixed with primary air admitted through said primary air opening;

f) said mixing chamber including a bluff body positioned such that gas emitted by the orifice impinges on said bluff body; and, g) said bluff body being formed at least partially by a dimple formed near said inlet end that projects into said mixing chamber.

10. A gas burner comprising:

a) an elongate, generally cylindrical sheet metal body having an inlet end and a closed distal end and a tubular segment extending between said ends;

b) said inlet end including an integrally formed gas orifice holder, said holder mounting a gas orifice element;

c) said inlet end further formed to define at least one primary air opening arranged to admit primary air into said tubular segment;

d) a plurality of flame ports defined in said tubular segment downstream from said inlet end, at least some of said flame ports defined by openings, each opening having two side edges and a front edge and a tab bent inwardly, such that an effective size of said flame port is determined by the degree to which said tab is bent inwardly;

e) a mixing chamber disposed between said orifice holder and said flame ports whereby gas emitted by said orifice is mixed with primary air admitted through said primary air opening; and, f) a first set of flame ports, each of said flame ports of said first set defined by two side edges, a front edge and a tab bent inwardly at a first predetermined orientation, and a second set of flame ports, each flame port of said second set defined by two side edges, a front edge and an associated tab bent inwardly at an orientation different from that of the orientation of the tabs of said first set.

* * * * *